US011802748B1

(12) United States Patent
Wei et al.

(10) Patent No.: US 11,802,748 B1
(45) Date of Patent: Oct. 31, 2023

(54) CROSSBOW HEAD ASSEMBLY STRUCTURE

(71) Applicant: Weifang Zhao's Bow and Crossbow Co., Ltd., Shandong (CN)

(72) Inventors: Ning Wei, Shandong (CN); Guangzhong Chen, Shandong (CN)

( * ) Notice: Subject to any disclaimer, the term of this patent is extended or adjusted under 35 U.S.C. 154(b) by 0 days.

(21) Appl. No.: 17/888,783

(22) Filed: Aug. 16, 2022

(30) Foreign Application Priority Data

Jun. 8, 2022 (CN) ..... 202210640237.0

(51) Int. Cl.
*F41B 5/12* (2006.01)

(52) U.S. Cl.
CPC ..... *F41B 5/123* (2013.01)

(58) Field of Classification Search
CPC ..... F41B 5/12; F41B 5/123; F41B 5/1403; F41B 5/0094
USPC ..... 124/25, 86, 88
See application file for complete search history.

(56) References Cited

U.S. PATENT DOCUMENTS 7,204,242 B2 * 4/2007 Dziekan ..... F41B 5/1469 124/25
7,823,572 B2 * 11/2010 Anderson ..... F41B 5/1469 124/25
7,891,348 B2 * 2/2011 Colley ..... F41B 5/105 124/25
8,387,603 B2 * 3/2013 Darlington ..... F41B 5/105 124/25
8,448,630 B1 * 5/2013 McPherson ..... F41B 5/00 124/25
8,522,762 B2 * 9/2013 Trpkovski ..... F41B 5/1453 124/900
8,839,775 B2 * 9/2014 Wasilewski ..... F41B 5/1426 124/89
8,844,508 B2 * 9/2014 Sims ..... F41B 5/123 124/25
8,997,728 B2 * 4/2015 Popov ..... F41B 5/0094 124/25.6
9,228,791 B2 * 1/2016 Saunders ..... F41B 5/1426
9,255,756 B1 * 2/2016 Wu ..... F41B 5/123
9,297,604 B1 * 3/2016 Sidebottom ..... F41B 5/105
9,513,080 B1 * 12/2016 Kempf ..... F41B 5/1411
9,829,268 B1 * 11/2017 Kempf ..... F41B 5/105
9,879,938 B1 * 1/2018 Isenhower ..... F41B 5/123
10,018,442 B1 * 7/2018 Kempf ..... F41B 5/123
10,018,443 B2 * 7/2018 Dziekan ..... F41B 5/123
10,267,592 B2 * 4/2019 Bartels ..... F41B 5/123
(Continued)

*Primary Examiner* — Alexander R Niconovich

(57) ABSTRACT

The structure discloses a crossbow head assembly structure, comprising a main bracket, crossbow pieces, pulleys, a main string, and auxiliary strings. The invention improves the assembling method of the crossbow piece and the hanging method of the crossbow string, and is equipped with a string adjusting device. Advantageous effects: 1. the forward speed of the pulley when the arrow is shot is superimposed on the forward speed of the main string; 2. the weight of the pulley can be reduced, so that the shooting speed of the crossbow arrow can be increased, and the impact of the pulley on the crossbow string can be reduced by the sudden stop of the pulley; no matter which crossbow string is broken, the other crossbow strings will be completely relaxed; 3. the crossbow string can be assembled without a bow opener; moreover, the accuracy of shooting can be adjusted very conveniently.

2 Claims, 7 Drawing Sheets

(56) References Cited

U.S. PATENT DOCUMENTS

| | | | | |
|---|---|---|---|---|
| 10,393,470 | B1 * | 8/2019 | Popov | F41B 5/105 |
| 10,458,742 | B1 * | 10/2019 | Kempf | F41B 5/123 |
| 10,473,418 | B2 * | 11/2019 | Shaffer | F41B 5/123 |
| 10,495,404 | B2 * | 12/2019 | Shaffer | F41B 5/1469 |
| 10,533,822 | B1 * | 1/2020 | Popov | F41B 5/0094 |
| 10,767,956 | B2 * | 9/2020 | Popov | F41B 5/123 |
| 10,907,925 | B2 * | 2/2021 | Shaffer | F41B 5/1449 |
| 10,962,323 | B2 * | 3/2021 | Langley | F41B 5/123 |
| 10,969,192 | B1 * | 4/2021 | Gallops, Jr. | F41B 5/123 |
| 11,022,398 | B1 * | 6/2021 | Kempf | F41B 5/105 |
| 11,105,580 | B2 * | 8/2021 | Romero | F41B 5/10 |
| 11,112,205 | B1 * | 9/2021 | Kempf | F41B 5/123 |
| 11,268,780 | B2 * | 3/2022 | Stanziale | F41B 5/105 |
| 11,274,899 | B2 * | 3/2022 | Ell | F41B 5/1403 |
| 11,371,795 | B1 * | 6/2022 | Kempf | F41B 5/105 |
| 11,378,350 | B1 * | 7/2022 | Kempf | F41B 5/123 |
| 11,402,171 | B2 * | 8/2022 | Trpkovski | F41B 5/123 |
| 11,402,172 | B2 * | 8/2022 | Liu | F41B 5/123 |
| 11,499,792 | B1 * | 11/2022 | Kempf | F41B 5/105 |
| 11,549,777 | B1 * | 1/2023 | Trpkovski | F41G 11/003 |
| 11,573,062 | B2 * | 2/2023 | Haas | F41B 5/105 |
| 11,635,274 | B2 * | 4/2023 | Trpkovski | F41B 5/123 124/25 |
| 2019/0301829 | A1 * | 10/2019 | Shaffer | F41B 5/123 |
| 2022/0307791 | A1 * | 9/2022 | Trpkovski | F41B 5/123 |

* cited by examiner

CROSSBOW HEAD ASSEMBLY STRUCTURE

TECHNICAL FIELD

The invention relates to the technical field of athletic equipment, in particular to a crossbow head assembly structure.

BACKGROUND ART

The crossbow is mainly composed of a crossbow arm and a crossbow head assembly, of which the crossbow head is the core part of the crossbow. In the prior art, the crossbow head assembly is mainly composed of a main bracket, a crossbow piece, two pulleys, a main string and an auxiliary string, which mainly has the following technical defects:

1. when the string is pulled, the two pulleys only have relatively adducted movement, and there is no forward and backward movement. The energy storage is small, the shooting speed of the crossbow arrow is small, and the range is short.
2. The pulley is provided with a string hanging block for hanging the main string and the auxiliary string, which increases the overall weight of the pulley, and the inertia during shooting arrows is large, which will cause great damage to the string; in order to reduce the probability of strings broken, the main and auxiliary strings are thicker, which will counteract the potential energy of the string and affect the speed of the arrow.
3. Each pulley is hanged with two auxiliary strings; if one of the auxiliary strings is broken, the force on the pulley will be unbalanced, which will cause damage to the pulley; in order to avoid damage to the pulley or reduce the damage to the pulley, it is necessary to strengthen the pulley, which will inevitably increase the overall weight of the pulley, and the inertia of the pulley will also be increased accordingly.
4. A bow opener is needed to assist when assembling the hanging string or changing the string, and the bow opener is large in size and weight, which is not easy to carry; in field work, if the crossbow string breaks, it is inconvenient to change.

SUMMARY OF THE INVENTION

The purpose of the invention is to provide a crossbow head assembly structure, so as to solve the above technical problems.

In order to solve the above problems, the technical solutions adopted in the invention are:

a crossbow head assembly structure, comprising a main bracket, crossbow pieces, pulleys, a main string, and auxiliary strings, wherein a first rotating shaft passes through and is fixed on the pulley, and a third rotating shaft and a second rotating shaft are respectively fixed at the front and rear ends of the main bracket; the front and rear ends of the crossbow piece are respectively fixed with a first rotating shaft seat and a second rotating shaft seat, and the first rotating shaft seat and the second rotating shaft seat are respectively hinged on the first rotating shaft and the second rotating shaft; the front end of the main bracket is fixed with the third rotating shaft; the third rotating shaft is equipped with a crossbow piece supporting wheel that can rotate on the third rotating shaft, and the crossbow piece supporting wheel contacts the inner side of the crossbow piece.

Preferably, the front end of the main bracket is fixed with a blocking rubber column, and the blocking rubber column is located outside the crossbow piece.

Preferably, the main bracket is in the shape of a left-right symmetrical butterfly, and the upper and lower sides of the left and right vertices of its front end are respectively fixed with a blocking rubber column; the inner sides of the two blocking rubber columns are respectively fixed with the third rotating shaft passing through the main bracket, and the upper and lower ends of the third rotating shaft are both equipped with the crossbow piece supporting wheel; the left and right vertices of the rear end of the main bracket are respectively fixed with the second rotating shaft passing through the main bracket; the pulley is provided with two, in left and right symmetrical, and the first rotating shaft passes through and is fixed on the two pulleys; the crossbow piece is provided with two sets, in left and right symmetrical, and each set comprises upper and lower crossbow pieces; the front and rear ends of the upper and lower crossbow pieces are respectively fixedly assembled with the first rotating shaft seat and the second rotating shaft seat; the first rotating shaft seats at the front end of the upper and lower crossbow pieces are respectively hinged on the upper and lower ends of the first rotating shaft; the second rotating shaft seats at the rear end of the upper and lower crossbow pieces are respectively hinged on the upper and lower ends of the second rotating shaft; the upper and lower crossbow piece supporting wheels respectively contact the inner sides of the upper and lower crossbow pieces, and the upper and lower blocking rubber columns are respectively located on the outsides of the upper and lower crossbow pieces.

Preferably, the left and right ends of the main string are respectively wound in the wheel grooves of the left and right pulleys, and the hanging rings at the left and right ends are respectively hung on the protruding points of the outer rings of the two pulleys; the auxiliary string is provided with two, and each pulley is equipped with one auxiliary string; the auxiliary string is folded in half, and the middle part thereof is hung on the pulley; after the two ends thereof are respectively wound from the auxiliary string wheel grooves on the upper and lower sides of the pulley, the hanging rings at the two ends are respectively hung on the main bracket.

Preferably, the outer ring of the pulley is provided with a hanging groove; the front part of the main bracket is fixed with fourth rotating shafts passing through the main bracket; the upper and lower ends of the fourth rotating shafts are respectively installed with an auxiliary string supporting wheel that can rotate on the fourth rotating shaft; the middle part of the auxiliary string is hung in the hanging groove of the pulley or any space of the pulley; after the two ends thereof are respectively wound from the auxiliary string wheel grooves on the upper and lower sides of the pulley and the auxiliary string supporting wheels on the upper and lower sides of the main bracket, the hanging rings at the two ends are respectively hung on the main bracket.

Preferably, the main bracket is provided with left and right string adjusting devices for adjusting the tightness of the two auxiliary strings respectively; the string adjusting device comprises a string adjusting bolt and a string adjusting nut; the main bracket is provided with a strip-shaped hole, and the string adjusting nut is assembled in the strip-shaped hole and can move along the strip-shaped hole; the string adjusting bolt radially passes through the strip-shaped hole from the rear of the main bracket, and the inner end is in threaded connection on the string adjusting nut; the string adjusting bolt outside the main bracket is provided with several butterfly springs; the upper and lower sides of the string adjusting nut are respectively fixed with a hanging block, and the hanging rings at both ends of the auxiliary string are respectively hung on the hanging blocks on the upper and lower sides.

Advantageous effect: compared with the prior art, the invention improves the assembling method of the crossbow piece and the hanging method of the crossbow string; at the same time, a string adjusting device for adjusting the auxiliary strings is provided on the main bracket, so that the invention has the following advantages:

1. after the assembly structure of the crossbow piece is improved, when the string is pulled, both ends of the crossbow pieces rotate relative to the rotating shaft; the crossbow piece supporting wheel is used as the fulcrum, and the middle part bows and bends outward, which can store more potential energy; at the same time, the pulley is driven to have a relatively adducted motion and a forward and backward motion; in this way, the forward speed of the pulley when the arrow is shot is superimposed on the forward speed of the main string, so that the arrow can be shot at a higher speed and has a longer range.
2. After the hanging method of the main string and the auxiliary string is improved, the weight of the pulley can be reduced, so that the shooting speed of the crossbow arrow can be increased, and the impact of the pulley on the crossbow string by the sudden stop of the pulley can be reduced (that is to say, the crossbow string can be made thinner and lighter, thereby further increasing the arrow speed); at the same time, no matter which crossbow string is broken, the other crossbow strings will be completely relaxed, which will not cause the unbalanced force on both sides of the pulley and cause damage to the pulley.
3. After a string adjusting device is provided, the string adjusting bolt can be rotated, and the auxiliary string hanging on the string adjusting nut can be tightened or loosened, so that the crossbow string can be assembled without a bow opener; moreover, adjusting the length of the left and right auxiliary strings can adjust the angular position of the pulley, so as to adjust the accuracy of shooting very conveniently.

BRIEF DESCRIPTION OF ACCOMPANY DRAWINGS

In the figures: 1 refers to the pulley; 11 refers to the auxiliary string wheel groove; 12 refers to the protruding point; 13 refers to the hanging groove; 14 refers to the space; 2 refers to the main string; 3 refers to the auxiliary string; 4 refers to the crossbow piece; 41 refers to the first rotating shaft seat; 42 refers to the second rotating shaft seat; 5 refers to the main bracket; 51 refers to the first rotating shaft; 52 refers to the second rotating shaft; 53 refers to the third rotating shaft; 53A refers to the crossbow piece supporting wheel; 54 refers to the fourth rotating shaft; 61 refers to the string adjusting bolt; 62 refers to the butterfly spring; 63 refers to the string adjusting nut; 64 refers to the hanging block.

SPECIFIC EMBODIMENT OF THE INVENTION

The invention will be further described hereinafter with reference to the drawings and specific embodiments.

Figure 1:
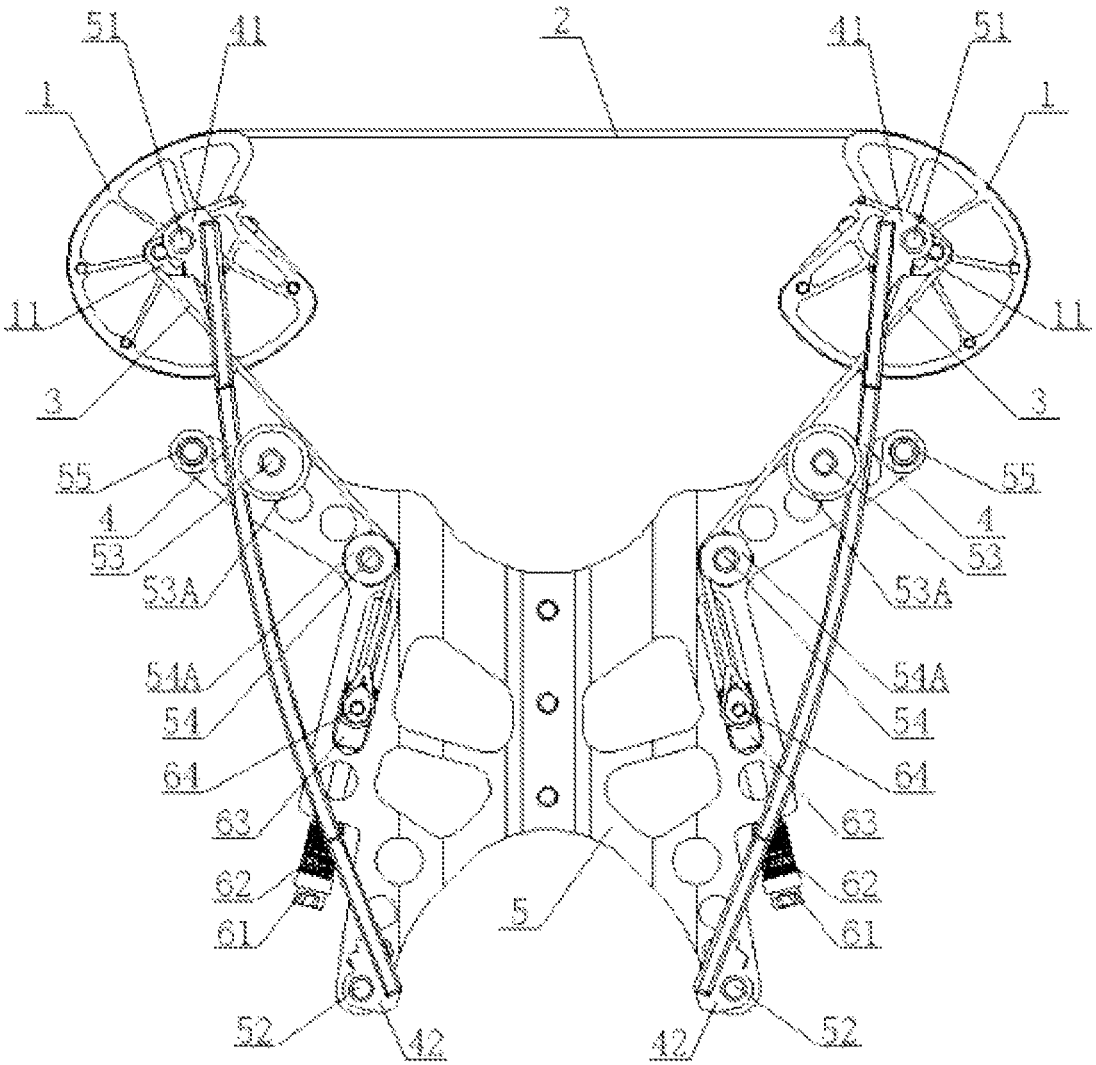
FIG. 1 is a schematic top view of the crossbow head assembly structure according to the invention in a state where the crossbow string is not tightened.
Figure 2:
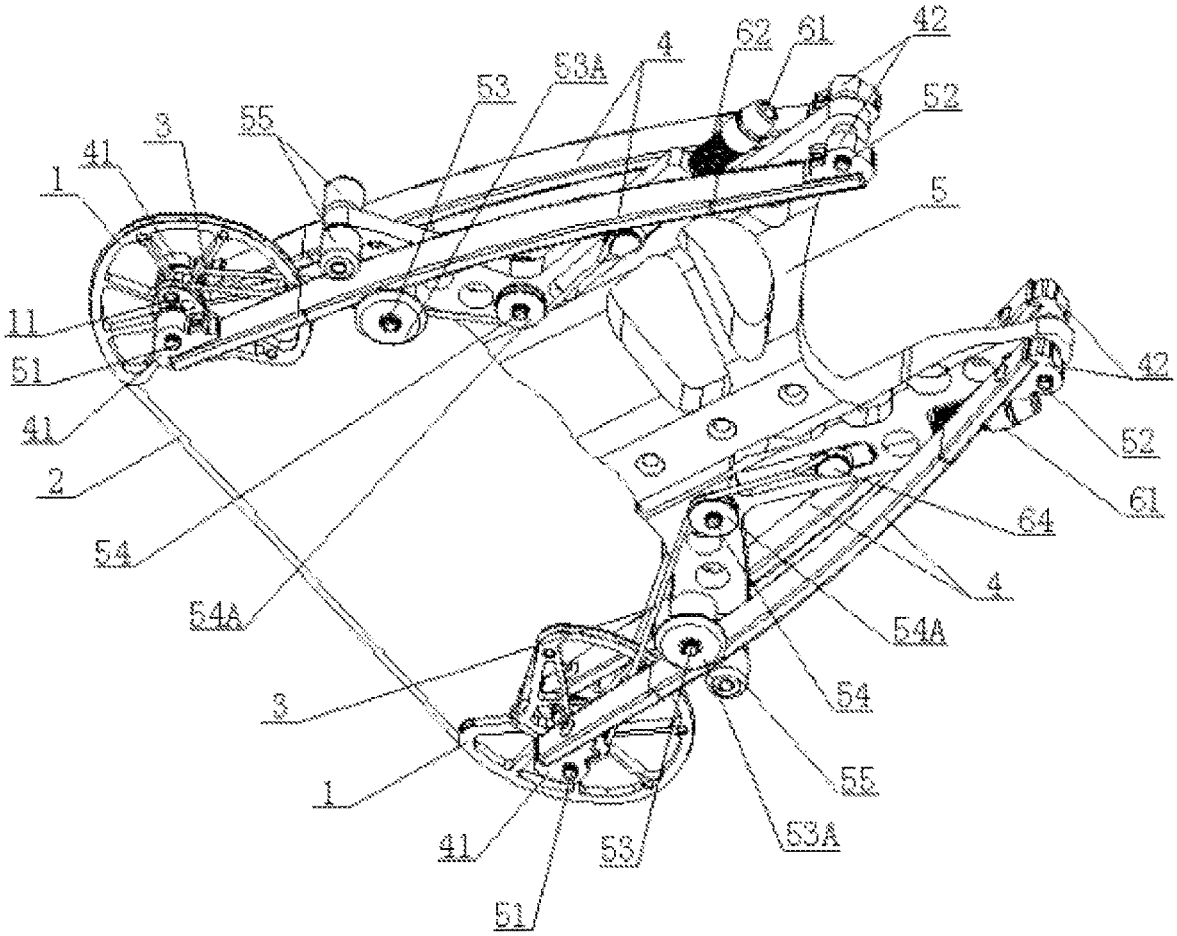
FIG. 2 is a three-dimensional schematic diagram of the crossbow head assembly structure according to the invention in a state where the crossbow string is not tightened.

Embodiment:

With reference to FIGS. 1 and 2, the crossbow head assembly structure according to the invention, comprising a main bracket 5, crossbow pieces 4, pulleys 1, a main string 2, and auxiliary strings 3.

The main bracket 5 is in the shape of a left-right symmetrical butterfly, the front end thereof is provided with left and right vertices, and the tail thereof is also provided with left and right vertices; the upper and lower sides of the left and right vertices of its front end are respectively fixed with a blocking rubber column 55; the inner sides of the two blocking rubber columns 55 are respectively fixed with the third rotating shaft 53 passing through the main bracket 5, and the upper and lower ends of the third rotating shaft 53 are both equipped with the crossbow piece supporting wheel 53A. The left and right vertices of the rear end of the main bracket 5 are respectively fixed with the second rotating shaft 52 passing through the main bracket 5. The pulley 1 is provided with two, in left and right symmetrical, and the first rotating shaft 41 passes through and is fixed on the two pulleys 1. The front part of the main bracket 5 is fixed with two fourth rotating shafts 54 passing through the main bracket 5; the upper and lower ends of the two fourth rotating shafts 54 are respectively installed with an auxiliary string supporting wheel 54A that can rotate on the fourth rotating shaft 54.

Figure 3:
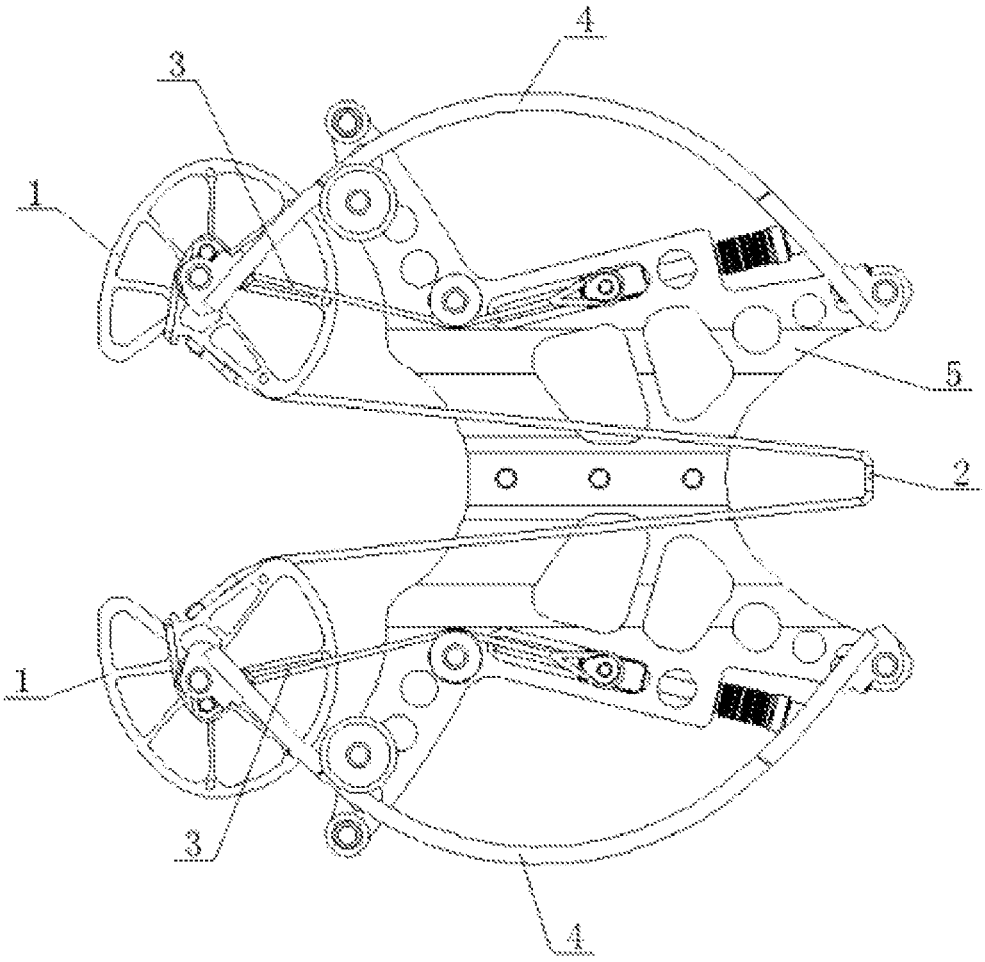
FIG. 3 is a schematic diagram of the crossbow head assembly structure according to the invention in a state where the crossbow string is tightened.

The crossbow piece 4 is provided with two sets, in left and right symmetrical, and each set comprises upper and lower crossbow pieces 4; the front and rear ends of the upper and lower crossbow pieces 4 are respectively fixedly assembled with the first rotating shaft seat 41 and the second rotating shaft seat 42. The first rotating shaft seats 41 at the front end of the upper and lower crossbow pieces 4 are respectively hinged on the upper and lower ends of the first rotating shaft 51; the second rotating shaft seats 42 at the rear end of the upper and lower crossbow pieces 4 are respectively hinged on the upper and lower ends of the second rotating shaft 52. The upper and lower crossbow piece supporting wheels 53A respectively contact the inner sides of the upper and lower crossbow pieces 4, and the upper and lower blocking rubber columns 55 are respectively located on the outsides of the upper and lower crossbow pieces 4. During use, if the crossbow string breaks, the blocking rubber column 55 can prevent the crossbow piece 4 from swinging backwards. The advantage of the assembly structure design of the crossbow piece is that, when the string is pulled, both ends of the two crossbow pieces rotate relative to the rotating shaft; the crossbow piece supporting wheel 53A is used as the fulcrum, and the middle part bows and bends outward, which can store more potential energy; at the same time, the pulley 1 is driven to have a relatively adducted motion and a forward and backward motion; as shown in FIG. 3, the forward speed of the pulley when the arrow is shot is superimposed on the forward speed of the main string, so that the arrow can be shot at a higher speed and has a longer range.

Figure 4:
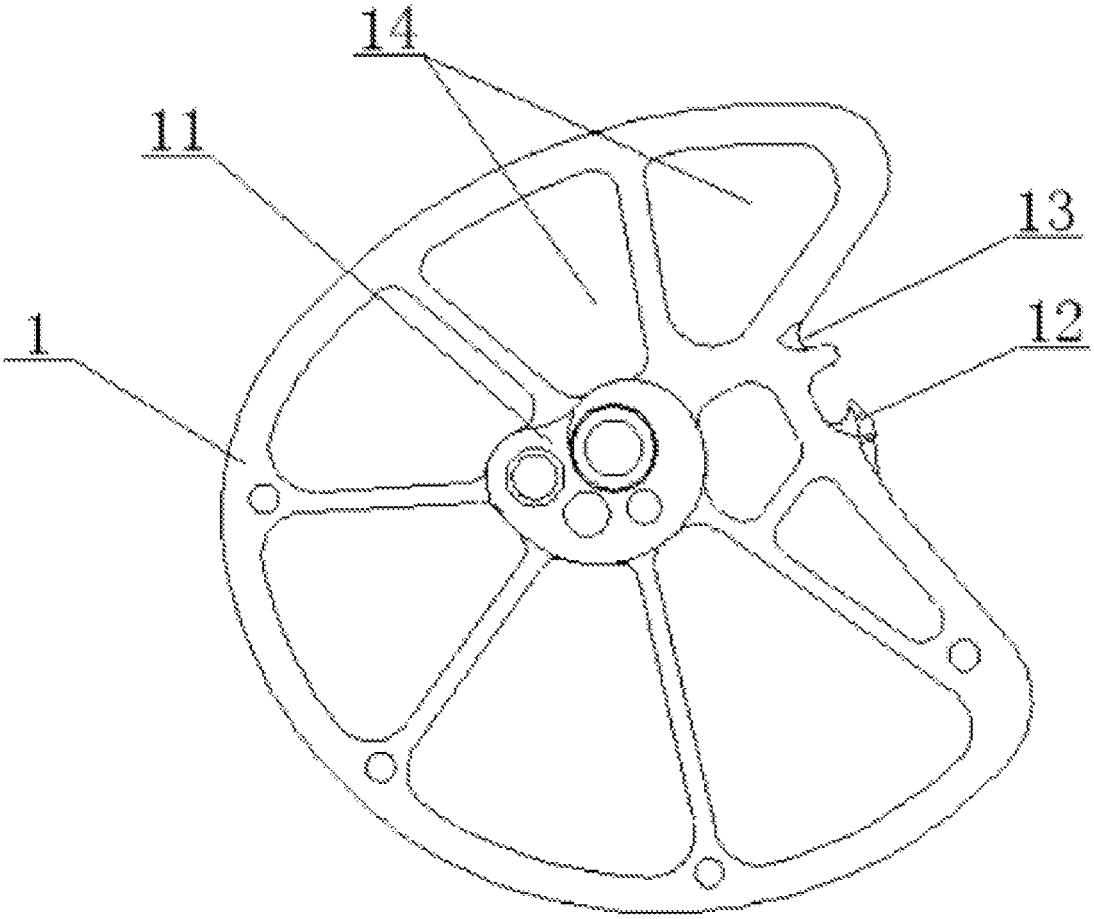
FIG. 4 is a structural diagram of the pulley according to the invention.
Figure 5:
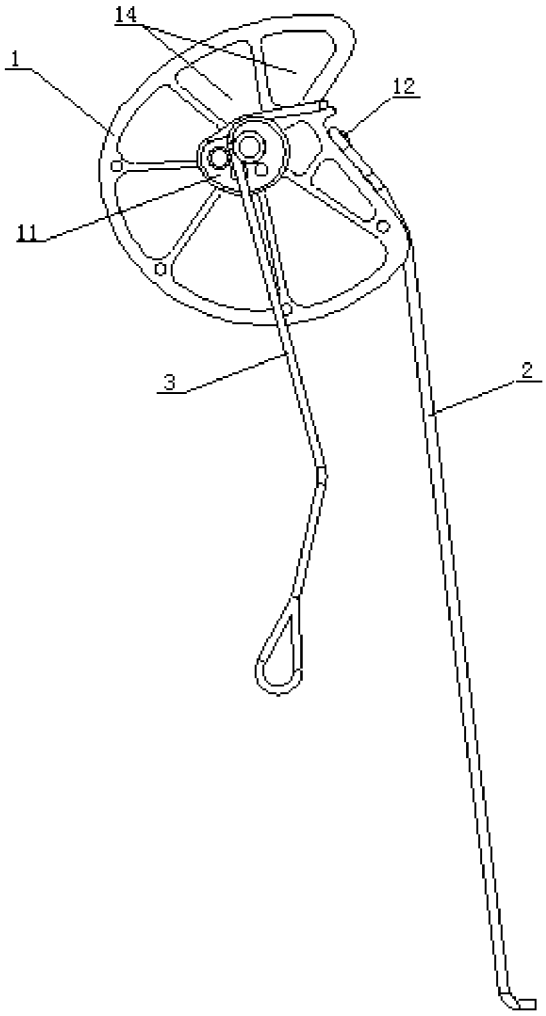
FIG. 5 is a first schematic structural diagram of the pulley hanging on the main string and the auxiliary string according to the invention.
Figure 6:
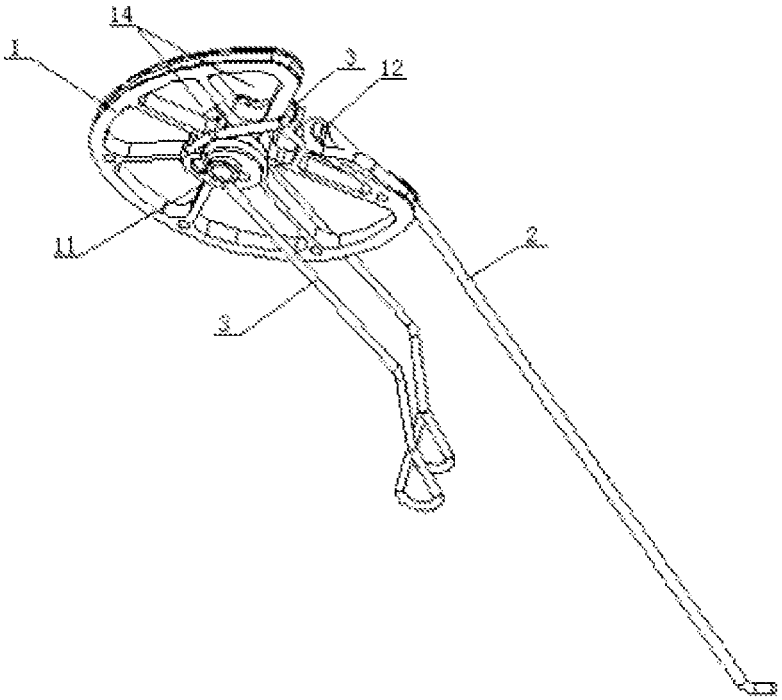
FIG. 6 is a second schematic structural diagram of the pulley hanging on the main string and the auxiliary string according to the invention.
Figure 7:
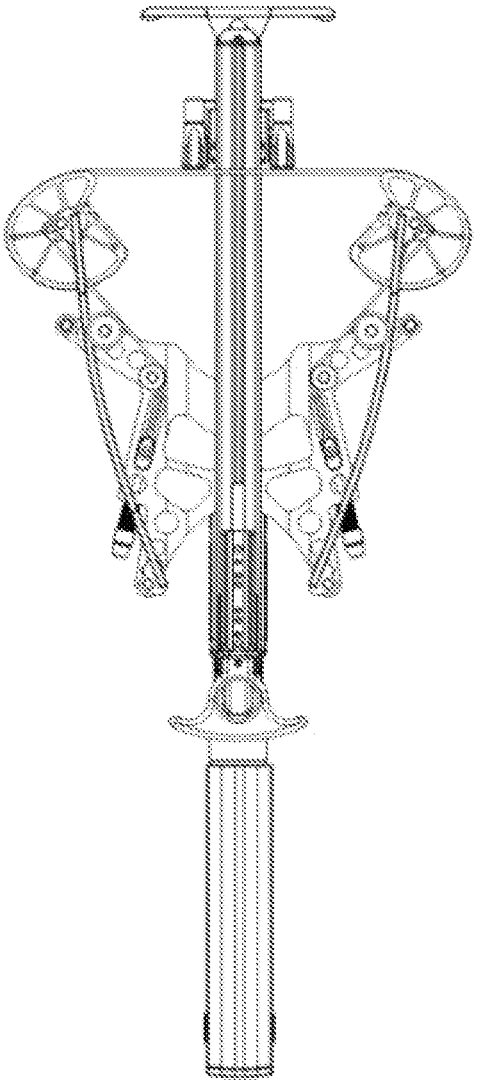
FIG. 7 is a schematic diagram of a crossbow equipped with the crossbow head assembly structure according to the invention.

As shown in FIGS. 4-6, the left and right ends of the main string 2 are respectively wound in the wheel grooves of the left and right pulleys 1, and the hanging rings at the left and right ends are respectively hung on the protruding points 12 of the outer rings of the two pulleys 1. The auxiliary string 3 is provided with two, and each pulley 1 is equipped with one auxiliary string 3. After the auxiliary string 3 is folded in half, the middle part thereof is hung in the hanging groove 13 of the pulley 1 or any space 14 of the pulley 1; after the two ends thereof are respectively wound from the auxiliary string wheel grooves 11 on the upper and lower sides of the pulley 1 and the auxiliary string supporting wheels 54A on the upper and lower sides of the main bracket 5, the hanging rings at the two ends are respectively hung on the main bracket 5. The advantages of the hanging method of the main string and the auxiliary string are: 1. the weight of the pulley can be reduced, so that the shooting speed of the crossbow arrow can be increased, and the impact of the pulley on the crossbow string by the sudden stop of the pulley can be reduced, that is to say, the crossbow string can be made thinner and lighter, thereby further increasing the arrow speed; 2. no matter which crossbow string is broken, the other crossbow strings will be completely relaxed, which will not cause the unbalanced force on both sides of the pulley and cause damage to the pulley.

The main bracket 5 is provided with left and right string adjusting devices for adjusting the tightness of the two auxiliary strings 3 respectively. The string adjusting device comprises a string adjusting bolt 61 and a string adjusting nut 63; the main bracket 5 is provided with a strip-shaped hole, and the string adjusting nut 63 is assembled in the strip-shaped hole and can move along the strip-shaped hole; the string adjusting bolt 61 radially passes through the strip-shaped hole from the rear of the main bracket 5, and the inner end is in threaded connection on the string adjusting nut 63; the string adjusting bolt 61 outside the main bracket 5 is provided with several butterfly springs 62, and the butterfly springs 62 can reduce the impact of the sudden stop of the pulley on the auxiliary string. The upper and lower sides of the string adjusting nut 63 are respectively fixed with a hanging block 64. The hanging rings at both ends of the auxiliary string 3 are respectively hung on the hanging blocks 64 on the upper and lower sides. The string adjusting bolt 61 can be rotated, and the auxiliary string hanging on the string adjusting nut 63 can be tightened or loosened, so that the crossbow string can be assembled without a bow opener; moreover, adjusting the length of the left and right auxiliary strings can adjust the angular position of the pulley, so as to adjust the accuracy of shooting very conveniently.

The above is only an embodiment of the invention, and is not intended to limit the scope of the patent of the invention on the other hand. Any equivalent structures made according to the contents of the description and drawings of the invention which are directly or indirectly used in other related technical fields shall all fall within the protection scope of the invention.

What is claimed is:

1. A crossbow head assembly structure, comprising a main bracket (5), crossbow pieces (4), a pulley (1), a main string (2), and auxiliary strings (3), wherein a first rotating shaft (51) passes through and is fixed on a pulley (1), and a third rotating shaft (53) and a second rotating shaft (52) are respectively fixed at a front and rear ends of the main bracket (5); a front and rear ends of the crossbow piece (4) are respectively fixed with a first rotating shaft seat (41) and a second rotating shaft seat (42), and the first rotating shaft seat (41) and the second rotating shaft seat (42) are respectively hinged on the first rotating shaft (51) and the second rotating shaft (52); the front end of the main bracket (5) is fixed with the third rotating shaft (53); the third rotating shaft (53) is equipped with a crossbow piece supporting wheel (53A) that can rotate on the third rotating shaft (53), and the crossbow piece supporting wheel (53A) contacts an inner side of the crossbow piece (4); the front end of the main bracket (5) is fixed with a blocking rubber column (55), and the blocking rubber column (55) is located outside the crossbow piece (4); the main bracket (5) is in a shape of a left-right symmetrical butterfly, and a upper and lower sides of a left and right vertices of its front end are respectively fixed with a blocking rubber column (55); an inner sides of a two blocking rubber columns (55) are respectively fixed with the third rotating shaft (53) passing through the main bracket (5), and a upper and lower ends of the third rotating shaft (53) are both equipped with the crossbow piece supporting wheel (53A); the left and right vertices of the rear end of the main bracket (5) are respectively fixed with the second rotating shaft (52) passing through the main bracket (5); the pulley (1) is provided with two, in left and right symmetrical, and the first rotating shaft (41) passes through and is fixed on the two pulleys (1); the crossbow piece (4) is provided with two sets, in left and right symmetrical, and each set comprises upper and lower crossbow pieces (4); a front and rear ends of a upper and lower crossbow pieces (4) are respectively fixedly assembled with a first rotating shaft seat (41) and a second rotating shaft seat (42); the first rotating shaft seats (41) at the front end of the upper and lower crossbow pieces (4) are respectively hinged on a upper and lower ends of the first rotating shaft (51); the second rotating shaft seats (42) at the rear end of the upper and lower crossbow pieces (4) are respectively hinged on the upper and lower ends of the second rotating shaft (52); the upper and lower crossbow piece supporting wheels (53A) respectively contact an inner sides of the upper and lower crossbow pieces (4), and a upper and lower blocking rubber columns (55) are respectively located on an outsides of the upper and lower crossbow pieces (4); a left and right ends of the main string (2) are respectively wound in a wheel grooves of the left and right pulleys (1), and a hanging rings at the left and right ends are respectively hung on a protruding points (12) of an outer rings of the two pulleys (1); the auxiliary string (3) is provided with two, and each pulley (1) is equipped with one auxiliary string (3); the auxiliary string (3) is folded in half, and a middle part thereof is hung on the pulley (1); after a two ends thereof are respectively wound from an auxiliary string wheel grooves (11) on a upper and lower sides of the pulley (1), a hanging rings at the two ends are respectively hung on the main bracket (5); the outer ring of the pulley (1) is provided with a hanging groove (13); a front part of the main bracket (5) is fixed with fourth rotating shafts (54) passing through the main bracket (5); a upper and lower ends of the fourth rotating shafts (54) are respectively installed with an auxiliary string supporting wheel (54A) that can rotate on the fourth rotating shaft (54); the middle part of the auxiliary string (3) is hung in the hanging groove (13) of the pulley (1) or any space of the pulley (1); after the two ends thereof are respectively wound from the auxiliary string wheel grooves (11) on the upper and lower sides of the pulley (1) and the auxiliary string supporting wheels (54A) on the upper and lower sides of the main bracket (5), the hanging rings at the two ends are respectively hung on the main bracket (5).

2. The crossbow head assembly structure of claim 1, wherein the main bracket (5) is provided with left and right string adjusting devices for adjusting a tightness of the two auxiliary strings (3) respectively; the string adjusting device comprises a string adjusting bolt (61) and a string adjusting nut (63); the main bracket (5) is provided with a strip-shaped hole, and the string adjusting nut (63) is assembled in the strip-shaped hole and can move along the strip-shaped hole; the string adjusting bolt (61) radially passes through the strip-shaped hole from a rear of the main bracket (5), and an inner end is in threaded connection on the string adjusting nut (63); the string adjusting bolt (61) outside the main bracket (5) is provided with several butterfly springs (62); an upper and lower sides of the string adjusting nut (63) are respectively fixed with a hanging block (64), and the hanging rings at both ends of the auxiliary string (3) are respectively hung on the hanging blocks (64) on an upper and lower sides.

* * * * *